United States Patent [19]

Nakajima et al.

[11] 4,267,483

[45] May 12, 1981

[54] INSULATOR ON SPARK PLUG ELECTRODE COATED WITH ZIRCONIUM AND VANADIUM OXIDES

[75] Inventors: Koichi Nakajima, Nagoya; Tomoji Ishiguro, Aichi; Tokuhiko Okamoto; Minoru Konaka, both of Nagoya; Minoru Nagai, Kariya; Kanji Higuchi, Hekinan; Kenji Sasaki, Kariya, all of Japan

[73] Assignees: Kabushiki Kaisha Toyota Chuo; Nippondenso Co., Ltd., both of Aichi, Japan

[21] Appl. No.: 43,843

[22] Filed: May 30, 1979

[30] Foreign Application Priority Data

Jun. 5, 1978 [JP] Japan ..... 53-67925

[51] Int. Cl.[3] ..... H01T 13/20

[52] U.S. Cl. ..... 313/143; 313/141

[58] Field of Search ..... 313/130, 137, 143

[56] References Cited

U.S. PATENT DOCUMENTS

| | | | |
|---|---|---|---|
| 2,899,585 | 8/1959 | Dollenberg | 313/143 |
| 3,252,034 | 5/1966 | Preist et al. | 333/252 X |
| 3,365,605 | 1/1968 | Linstedt | 313/143 X |

FOREIGN PATENT DOCUMENTS

| | | | |
|---|---|---|---|
| 50-43629 | 12/1975 | Japan | 313/143 |

*Primary Examiner*—Robert Segal

*Attorney, Agent, or Firm*—Berman, Aisenberg & Platt

[57] ABSTRACT

A spark plug for an internal combustion engine comprises (a) an insulator surrounding a central electrode and (b) a housing having a grounded electrode and disposed on the periphery of the insulator. A taper-nose portion of the insulator, which is designed to be exposed to unburnt carbon in combustion gases of a combustion chamber, is modified to facilitate carbon removal from the taper-nose portion and to maintain excellent electrical insulation. The modification comprises a coating of a mixture of vanadium oxide and zirconium oxide in the form of a porous layer or a sponge-like porous layer having an irregularly-shaped structure with pores; it is fixed to the exposed surface of the taper-nose portion to improve the self-cleaning ability of the spark plug without decreasing the degree of electrical insulation provided by the insulator. The coating of the mixture having the porous structure is formed by applying a suspension of the mixture to the taper-nose portion of the spark plug and by drying the same in situ. The resulting coating is then heated further to obtain a more adherent coating of increased durability and better self-cleaning ability.

16 Claims, 7 Drawing Figures

INSULATOR ON SPARK PLUG ELECTRODE COATED WITH ZIRCONIUM AND VANADIUM OXIDES

RELATED APPLICATION

This application is related to copending Application Ser. No. 950,541, filed Oct. 12, 1978, the entire disclosure of which is incorporated herein by reference.

FIELD OF THE INVENTION

The invention relates to an insulator having a taper-nose exposed portion and designed to separate a central electrode of a spark plug from a grounded electrode thereof.

BACKGROUND

After a new motor vehicle (powered by a gasoline engine) is assembled in an automobile factory, it is often moved (for transport to a motor pool or for loading into a truck or a cargo boat for exportation before it is delivered to a user) by running the gasoline engine. The running mode for this movement is not uniform, but the speed of the vehicle is ordinarily at from approximately 30 to 40 km per hour, and the running distance is about 500 meters for each movement. The condition of driving is low speed—short distance. When the gasoline engine is driven at such low speed over a short distance, each spark plug (mounted on the engine of the vehicle) tends to smolder. Smoldering reduces the insulation resistance of the spark plug and may lead to misfiring and defective running. Such a smoldering phenomenon is especially frequent when ambient air is cold, for example in winter. Furthermore, such smoldering occurs not only in a new car, such as in the previously-described case, but also in used cars in general in the wintertime.

Such smoldering results from deposition of unburnt carbon, such as soot, caused by combustion of gasoline within an engine, on the surface of a taper-nose portion 61 of an insulator 6 of a spark plug 1, as shown in FIG. 1, when that surface is exposed to combustion gases. [In the drawing, the reference numeral 2 represents a housing; 3, a grounded electrode; 4, a washer; and 5, a central electrode.]

To solve the instantly-noted problem, the grounded electrode could be specially designed to use a creeping discharge to remove any deposit of unburnt carbon. However, the structure between the taper-nose portion 61 of insulator 6 and the grounded electrode 3 is complex for such a solution, and difficulties are encountered in producing spark plugs of this type.

SUMMARY OF THE INVENTION

This invention relates to a spark plug having an insulator with a taper-nose portion and designed for easy removal of unburnt carbon which adheres to the surface of the taper-nose portion of the insulator. It also relates to a method of producing such a spark plug. More particularly, it relates to the insulator, a specific porous coating, a method of coating an exposed portion of the insulator, the resulting coated insulator and a method of facilitating the self-cleaning capability of a spark plug.

The present invention resides in a spark plug [comprising (a) an insulator having an exposed taper-nose portion and surrounding a central electrode and (b) a housing having a grounded electrode and disposed on the periphery of the insulator] for an internal-combustion engine. A coating of a mixture of vanadium oxide and zirconium oxide is fixed to the surface of the taper-nose portion of the insulator which is exposed to combustion gas from the internal-combustion engine.

Thus, according to this invention, a spark plug having superior self-cleaning ability is provided by fixing a coating 7 of a mixture of vanadium oxide and zirconium oxide to the surface of the taper-nose portion of the insulator. Moreover, since, in the present invention, the coating of the aforesaid mixture is fixed, the electrical insulation of the surface of the taper-nose portion 61 of the insulator is not impaired, and the electrical insulating property (which is necessarily required in a spark plug) of the surface is retained as in conventional spark plugs. Hence, an excellent spark plug is provided. In addition, the coating 7 is readily and simply formed by coating a mixture of vanadium oxide and zirconium oxide, e.g., in the form of a suspension and drying or baking the resulting coating.

OBJECTS OF THE INVENTION

The present invention aims at removing defects of prior-art techniques and at providing a spark plug having superior self-cleaning ability and designed to facilitate removal of unburnt carbon deposited on the surface of the taper-nose portion 61 of the insulator.

An object of this invention is thus to provide a spark plug designed for easy removal of unburnt carbon adhering to the surface of the taper-nose portion of its insulator and having improved self-cleaning ability.

Another object of the invention is to provide a spark plug having not only improved self-cleaning ability but also excellent electrical insulator provided by the plug insulator.

A further object of the invention is to provide a spark plug having increased durability and better self-cleaning ability.

A still further object of the invention is to provide a spark plug having a mixture of vanadium oxide and zirconium oxide fixed to the peripheral surface of the taper-nose portion of its insulator.

An additional object of the invention is to provide a process for producing a spark plug having the previously-described characteristics.

The foregoing and other objects are effected by the invention, as is apparent from the following description and claims.

DETAILS

When unburnt carbon is deposited on the surface of the taper-nose portion 61 of a spark plug 1 as a result of running an engine at a low temperature over a short distance, the temperature of the spark plug rises as a result of the temperature rise within the engine chamber during the next running. The deposited carbon is spontaneously removed, thus resulting in the cleaning of the spark plug. The ability of a particular spark plug to perform this self-cleaning function is what is herein referred to as its self-cleaning ability. In this connection self-cleaning is preferably effected at the lowest possible temperature. For a spark plug having a self-cleaning temperature of about 550° C. with no countermeasure taken for self-cleaning, it is thus desirable to lower the self-cleaning temperature to below 500° C., preferably to below 470° C., by suitable countermeasures for self-cleaning. This also results in improved self-cleaning.

The most important feature of this invention is that the coating of the mixture of vanadium oxide and zirconium oxide adheres to the surface of the taper-nose portion 61 of the insulator. The presence of the coating on the insulator imparts thereto a high degree of self-cleaning ability and has the further advantage that it does not in any way impair the electrical-insulating property of the surface of the insulator of the spark plug. When only vanadium oxide is fixed to the entire surface of the insulator, the electrical insulation of the surface of the taper-nose portion of the insulator is destroyed during the use of the spark plug, and the inherent function of the spark plug is reduced (See Example 3.)

Figure 1:
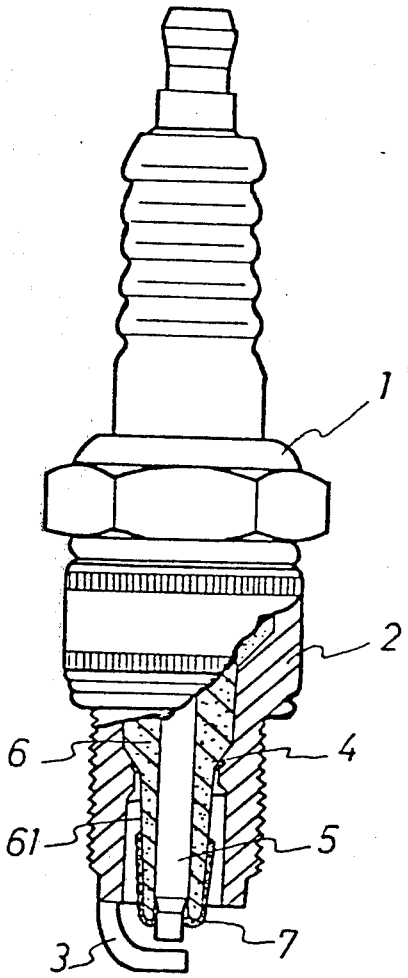
FIG. 1 is a side view of a spark plug, partially shown in cross-section.
Figure 2A:
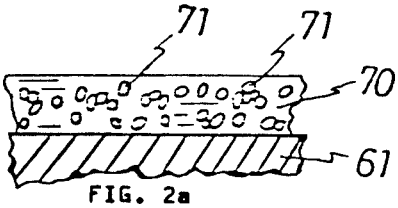
FIGS. 2*a* to 2*c* are views depicting progressive stages in forming a (vanadium oxide)/(zirconium oxide) coating.
Figure 2B:
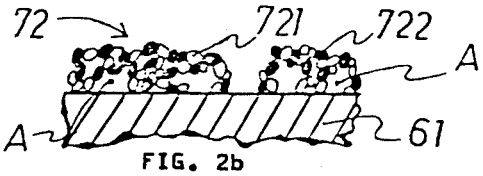
Figure 2C:
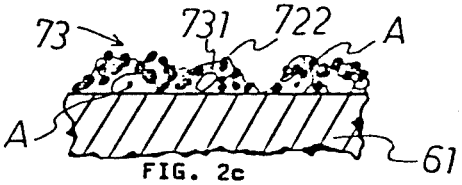

The coating of the aforesaid mixture is fixed to the surface of the taper-nose portion of the insulator. When the coated layer is only dried after coating, the structure of the obtained coating is a porous body in which the mixture of vanadium oxide particles 721 and zirconium oxide particles 722 is present on the surface of the taper-nose portion 61 as shown at 72 in FIG. 2*b;* among these particles, pores A are present. When the coated layer is dried and then heated, the vanadium oxide particles 721 are melted and thus assume a condition enclosing the zirconium oxide particles 722 therein, or the vanadium oxide particles bond the zirconium oxide particles 722 to one another. Subsequent cooling provides a coating 73 which, as shown in FIG. 2*c,* is composed of the zirconium oxide particles 722 and a layer 731 of irregularly-shaped vanadium oxide. The coating 73 forms a porous sponge-like layer having an irregularly-shaped structure with pores A.

The coating forms a sponge-like porous body because the zirconium oxide particles are not melted by the aforesaid heating. Accordingly, to form a coating of such a sponge-like porous structure, it is preferable to include at least 50 percent by weight of zirconium oxide power in the mixture. With such a sponge-like porous body, the neighborhood of the firing portion of the spark plug is easy to maintain at a high temperature and, therefore, unburnt material, such as carbon, deposited on the insulating portion is easily removed. When the amount of the zirconium oxide powder in the mixture is less than 50 percent by weight, it is difficult to form the previously-described sprong-like structure, and the coating dots the surface of the taper-nose portion like islands. Even in such a case, however, excellent self-cleaning ability is achieved, as confirmed by the Examples.

The coating layer is formed, for example, by suspending a powdery mixture of vanadium oxide and zirconium oxide (as materials for forming the coating) in a liquid, such as water or an alcohol (e.g. ethyl alcohol), coating the resulting suspension on the surface of the taper-nose portion 61 of the insulator, and drying the coating. The drying is carried out at from 40° to 100° C. As a result of this drying, the coating layer of a porous body composed of vanadium oxide and zirconium oxide is fixed to the surface of the taper-nose portion of the insulator with a relatively weak force. To obtain increased durability and better self-cleaning ability, the dried coating is then heated at a temperature within the range of from 700° to 900° C. for a period of from about 5 minutes to 30 minutes. The heating causes melting of the vanadium oxide, and the aforesaid mixture is bonded intimately to the surface of the taper-nose portion and becomes a sponge-like porous body as previously described. The coating is effected, e.g., by dipping the taper-nose portion 61 in the suspension or by brush-coating or spray-coating the suspension on this portion. The concentration of the noted mixture in the employed suspension is from 0.01 to 10 percent (by weight; the same will apply hereinafter). Concentrations of from 0.5 to 5 percent are preferred because the self-cleaning ability thus achieved has excellent durability.

The vanadium oxide (as a raw material for the formation of coating 7) includes vanadium pentoxide ($V_2O_5$), vanadium trioxide ($V_2O_3$) or a mixture thereof, and any of these varieties of vanadium oxide is appropriately used. For practical purposes, vanadium pentoxide is ordinarily used, as shown in the Examples.

The zirconium oxide includes zirconium dioxide ($ZrO_2$), zirconium monoxide (ZrO) or a mixture thereof, but any of these varieties of zirconium oxide is appropriately used. For practical purposes, zirconium dioxide is ordinarily employed, as shown in the Examples. The coating brings about the noted advantageous effects of this invention irrespective of the type of vanadium oxide or zirconium oxide employed.

The preferred composition for the subject mixture comprises from 5 to 99 percent (by weight; the same will apply hereinafter) of vanadium oxide, calculated as vanadium pentoxide, and from 1 to 95 percent of zirconium oxide, calculated as zirconium oxide. The aforesaid self-cleaning effect is difficult to achieve outside this range. The oxides are preferably employed in the form of powder having a particle diameter of from about 0.1 to 2 microns. The average thickness of the coating is preferably not more than 10 microns from the viewpoint of electrical insulation. However, if it is less than 0.1 micron, the self-cleaning ability might be reduced.

The adherence of the coating is effected by coating and drying, or by subsequent heating, as previously described. The state of the particles of the mixture in each of the respective steps is described hereafter. Specifically, as shown in FIGS. 2*a* to 2*c,* application of the suspension to the surface of the taper-nose portion 61 of the insulator forms a layer (FIG. 2*a*) of suspension 70 wherein powdered particles 71 (of vanadium oxide or zirconium oxide or both) are in the form of primary particles or secondary agglomerated particles in a suspended state. Drying (in the next step) provides, on the surface of the taper-nose portion 61 of the insulator, a coating 72 composed of vanadium oxide particles 721 and zirconium oxide particles 722 (FIG. 2*b*). The coating 72 is porous with pores A, as shown in FIG. 2*b.* When the coating is heated further after drying, the vanadium oxide particles 721 in the mixture are melted, and thereafter adhere even more closely to the surface of the taper-nose portion of the insulator and to the zirconium oxide particles, thus bonding zirconium oxide particles to each other and to the insulator surface. Subsequent cooling leads to solification of the molten particles and to fixation of the resulting coating to the surface of the taper-nose portion of the insulator, thereby forming coating 73 (FIG. 2*c*). The coating 73 is a porous sponge-like layer having an irregularly-shaped structure with pores A (see microphotographs of FIGS. 3*a* and 3*b* and Example 1).

In the drawings the designated elements are as follows:

1—spark plug
2—housing
3—grounded electrode
4—washer
5—central electrode
6—insulator
7—coating
61—taper-nose portion
70—suspension
71—powdery mixture
72—coating layer
73—coating layer
721—vanadium oxide particles
722—zirconium oxide particles
731—molten or solidified vanadium oxide
A—pores in the coating

EXAMPLE 1

A commercially-available spark plug having no fixed coating 7 for self-cleaning is provided. A liquid suspension of a mixture of vanadium pentoxide ($V_2O_5$) powder and zirconium dioxide ($ZrO_2$) powder (as materials for forming the coating in accordance with this invention) is applied to the surface of taper-nose portion 61 of insulator 6 of the spark plug. The spark plug insulator is dried at about 60° C. for 30 seconds, and heated in an electric furnace at 750° C. for 20 minutes. Thereafter, the heated spark plug insulator is cooled to produce a spark plug having formed on the surface of the taper-nose portion 61 a coating 7 having a sponge-like porous layer composed of a mixture of vanadium oxide and zirconium oxide. In this Example 1, the concentrations of the mixture in the suspension are, respectively, 5, 1, 0.5, 0.1 and 0.01 percent (by weight), and the mixing ratio of the two powders is such that 30 percent is vanadium pentoxide and 70 percent is zirconium dioxide, as shown in Table 1. The application of thus prepared liquid suspension is effected by dipping the taper-nose portion 61 once in the suspension. The suspension is applied to an area ranging from the tip portion of the taper-nose portion 61 to a point 10 mm above it. The aforesaid powders of the mixture have a particle diameter of from 0.5 to 6 microns, and these particles are mixed and pulverized by a grinder to form a powder mixture having a particle diameter of from about 0.1 to 2 microns. Ethyl alcohol is used as the suspending liquid.

The average thickness of each coating on the taper-nose portion of the insulator in the resulting spark plugs is shown in Table 1.

The resulting spark plug is mounted in an automobile engine in the customary manner. The engine is then run while cooling the engine wall with cooling water to maintain the temperature of the taper-nose portion 61 of the insulator 6 of the spark plug at less than 150° C. Thus, a large amount of carbon is deposited on the surface of the taper-nose portion 61. The spark plug is then detached from the engine, and placed in an electric furnace. The temperature within the furnace is raised, and the temperature (carbon-removal temperature) at which the deposit is removed is measured. The aforesaid engine is run at 1,000 rpm for 8 minutes with an air-to-fuel ratio of from 5 to 6.

The results are shown in Table 1.

The Table also shows the results of a similar measurement on the commercially available spark plug in which the coating in accordance with this invention is not formed (No. $C_1$).

It is seen from Table 1 that the spark plugs in accordance with this invention (Nos. 1 to 5) can remove the deposit at lower temperatures (i.e., 90° to 110° C.) than the commercially-available spark plug (No. $C_1$) having no coating formed thereon.

The carbon removal temperature means a temperature at which unburnt carbon adherent to the taper-nose portion of the insulator is completely removed from at least the tip or end of the taper-nose portion, so that the surface of the insulator surrounding the tip portion of the central electrode is maintained in an electric-insulation state. This carbon-removal temperature corresponds to a self-cleaning temperature and, to improve the self-cleaning, lowering of this self-cleaning temperature is required.

Figure 3A:
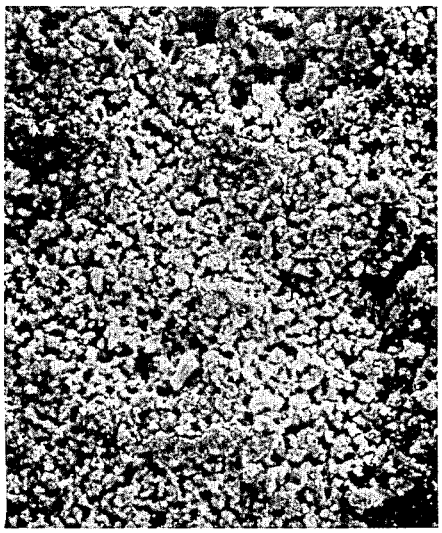
FIGS. 3*a* and 3*b* are scanning microphotographs (magnification—1,000× and 10,000×) of the coating (on the surface of the taper-nose portion of an insulator) at the stage corresponding to that of FIG. 2*c*.
Figure 3B:
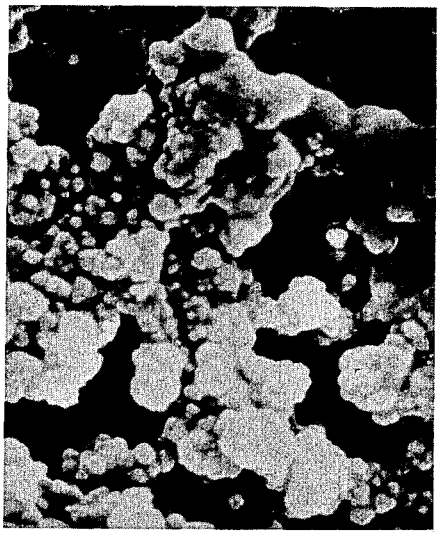
Figure 4:
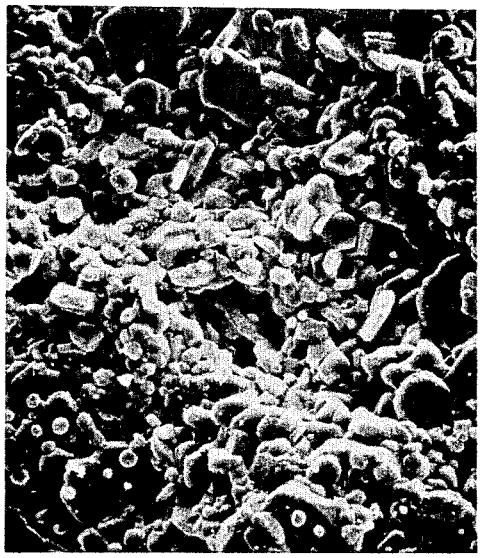
FIG. 4 is a similar scanning microphotograph (magnification—1,000×) of the same taper-nose portion before the formation of the coating.

To examine the dispersed state of the coating composed of the aforesaid mixture of vanadium oxide and zirconium oxide in the spark plugs produced in the previously-noted manner, a scanning electron microphotograph of the taper-nose portion of the insulator is taken. FIG. 3*a* is a scanning electron microphotograph (magnification: 1000×) of the spark plug No. 3 in Table 1. In this FIG. 3*a*, the coating of this invention is an assembly of many small particles composed of vanadium oxide and zirconium oxide. To examine a portion of the coating more clearly, this photograph is enlarged (magnification 10,000×), as shown in FIG. 3*b*. It is seen from these two FIGS. (3*a* and 3*b*) that the coating is of a porous sponge-like structure, as previously described. For comparison, a similar scanning electron microphotograph (magnification 1,000× as in FIG. 3*a*) of the taper-nose portion of the insulator in a commercially-available spark plug (before treatment in according with this invention) is shown in FIG. 4. It is seen from FIGS. 3*a* and 4 that the surface of the taper-nose portion on which the coating (in accordance with this invention) is formed differs in structure from the surface of the taper-nose portion having no such coating.

TABLE 1

| No. | Concentration of the Coating Mixture (wt. %) | Average Thickness of the Coating (microns) | Carbon-Removal Temperature (°C.) |
|---|---|---|---|
| 1 | 5 | 8.0 | 440 |
| 2 | 1 | 1.6 | 440 |
| 3 | 0.5 | 0.8 | 440 |
| 4 | 0.1 | 0.16 | 460 |
| 5 | 0.01 | 0.016 | 460 |
| $C_1$ | Not coated | — | 550 |

EXAMPLE 2

By varying the concentration of the mixture composed of $V_2O_5$ and $ZrO_2$, a variety of spark plugs are produced in a manner similar to that of Example 1, and the durability of the self-cleaning ability of each spark plug is measured. The mixing ratio of the oxides in the mixture is the same as in Example 1.

Specifically, carbon is similarly made to adhere to respective spark plugs which are the same as those in Example 1. The temperature at which such carbon is removed from the spark plug is measured, and then carbon is again made to adhere to the same spark plug according to the same procedure. The temperature at which this carbon is removed therefrom is then measured. This procedure of adhesion and removal of carbon to and from the spark plug is repeated six times for each spark plug. Prior to a succeeding procedure of adhering carbon, each spark plug is carefully examined to determine whether carbon adherent to the spark plug in the preceding cycle has been completely removed.

Carbon-removal temperatures at respective cycles for each spark plug are shown in Table 2. The measurement for the commercially-available untreated spark plug (No. $C_2$) is also given in Table 2.

TABLE 2

| No. | Concentration of the Coating Mixture (wt. %) | Carbon-Removal Temperature (°C.) | | | | | |
|---|---|---|---|---|---|---|---|
| | | First | Second | Third | Fourth | Fifth | Sixth |
| 6 | 5 | 440 | 440 | 440 | 450 | 450 | 450 |
| 7 | 1 | " | " | " | 440 | 440 | 440 |
| 8 | 0.5 | " | " | 450 | 450 | 450 | 460 |
| 9 | 0.1 | 460 | 460 | 460 | 470 | 470 | 470 |
| 10 | 0.01 | " | " | 470 | " | 490 | 490 |
| $C_2$ | Not coated | 550 | 550 | 550 | 550 | 550 | 550 |

It is seen from Table 2 that the removal temperature for adhering matter (or deposit), such as carbon, is maintained low even after six cycles of carbon-adhesion and removal for spark plugs (Nos. 6 through 10) of the present invention; particularly in the case of the spark plugs (Nos. 6 through 9) treated with a suspension having at least 0.1 percent by weight of the mixture, the removal temperatures are from 80° to 110° C. lower than that for the untreated spark plug (No. $C_2$), thus reflecting superior durability of the self-cleaning ability.

EXAMPLE 3

By varying the concentration of the mixture of $V_2O_5$ and $ZrO_2$, spark plugs (Nos. 11 and 12) are produced in a manner similar to that of Example 1, and carbon is made to adhere thereto in like manner. The adhering or deposited carbon is then removed at 450° C. The electrical insulating property of the surface of the taper-nose portion of the insulator of each plug is determined by measuring the electric resistance between the central electrode and the grounded electrode of each spark plug.

For comparison, a spark plug (No. $C_3$) is prepared by applying a thick paste (consisting of 70% by weight of vanadium pentoxide and 30% by weight of water) coating to the surface of the taper-nose portion of the insulator of the spark plug, drying the spark plug, and heating or baking it at 750° C. in an electric furnace for 20 minutes. There is thus obtained a spark plug (No. $C_3$) having a layer of vanadium oxide formed uniformly over the entire surface of the taper-nose portion thereof. Carbon is then made to adhere to the spark plug; it is subsequently removed at 450° C. The electrical insulation of the plug (No. $C_3$) is also measured in the same manner as previously indicated.

The results are given in Table 3, together with the concentrations of the mixture in the prepared suspension and of $V_2O_5$ in the applied paste, the state of the coating fixed to the surface of the taper-nose portion of the insulator and the average thickness of the coating.

Table 3 shows that the spark plugs in accordance with the present invention remain infinite in electric resistance even after service. In contrast, in the ignition plug (No. $C_3$) having a uniform non-porous coating of $V_2O_5$ alone of 150μ in thickness, the electric insulation of the taper-nose portion is broken down by only one cycle of adhesion of carbon and removal thereof by heating, and the spark plug No. $C_3$ nearly lost its inherent function. With spark plugs Nos. 11 and 12 in Table 3, there is no breakdown in electric insulation even after 6 cycles of a carbon-adhering and removing operation.

TABLE 3

| No. | Concentration of the Coating Mixture/(wt. %) | State of the Coating | Average Thickness of the Coating (microns) | Electric Resistance |
|---|---|---|---|---|
| 11 | 0.1 | Porous | 0.16 | Infinite |
| 12 | 1.0 | " | 1.6 | " |
| $C_3$ | 70 ($V_2O_5$ concentration) | Non-porous | 150 | 0.1 MΩ |

No. $C_3$ spark plug turned light brown in the coated area of the taper-nose portion because of the application of a large amount of $V_2O_5$. This area turns black when the plug is heated for removal of the adhering matter or deposit. This change to a black color is considered to have some relation to the aforesaid change in electric insulation.

EXAMPLE 4

Spark plugs (Nos. 13 to 17) are produced in the same way as in Example 1 except that the drying subsequent to the application of the suspension is effected at 100° C. for 30 seconds, and heating after drying is omitted. The duration of the self-cleaning ability of these spark plugs is measured in the same manner as in Example 2.

The results are given in Table 4. The results of the test for the untreated plug No. $C_2$ are also given in this Table.

TABLE 4

| No. | Concentration of the Coating Mixture (wt. %) | Carbon Removal Temperature (°C.) | | | | | |
|---|---|---|---|---|---|---|---|
| | | First | Second | Third | Fourth | Fifth | Sixth |
| 13 | 5 | 440 | 440 | 440 | 460 | 460 | 470 |
| 14 | 1 | " | " | " | 440 | 440 | 480 |
| 15 | 0.5 | " | " | 460 | 460 | 480 | 500 |
| 16 | 0.1 | 460 | 460 | 480 | 510 | 550 | 550 |
| 17 | 0.01 | " | " | 510 | 540 | " | " |
| $C_2$ | Not coated | 550 | 550 | 550 | 550 | 550 | 550 |

It is seen from Table 4 that the spark plugs obtained by simply drying the resulting coatings also had superior self-cleaning ability. A comparison of this Table 4 with Table 2 shows that the spark plugs of Example 2 obtained by effecting the heat-treatment after drying have better durability in self-cleaning ability than those obtained in this Example 4 in which the heat-treatment is not performed.

In this Example 4, the mixing ratios of a powdery mixture of vanadium pentoxide and zirconium dioxide are 20 percent to 80 percent, 10 percent to 90 percent, 5 percent to 95 percent, and 80 percent to 20 percent, respectively, and each of them is used as a 10 percent suspension. The self-cleaning ability of each of the spark plugs was examined. It is found that all of these spark plugs have superior self-cleaning ability, similar to that shown in Example 1.

Furthermore, aside from the foregoing Examples, the spark plugs in accordance with this invention produced by performing the drying or both the drying and heating are mounted in an engine, and the engine is run at a low speed over a short distance in the same way as in actual running. All of the spark plugs prove to be excellent and do not smolder.

The invention and its advantages are readily understood from the preceding description. Various changes may be made in the coating composition, in the coated insulator, in the method of coating the insulator and in the resulting spark plug without departing from the spirit and scope of the invention or sacrificing its material advantages. The processes, compositions, products and uses, hereinbefore described, are merely exemplary of preferred embodiments and do not in any way limit the claims which follow.

What is claimed is:

1. An insulator for electrically insulating an axially-disposed electrode from a surrounding casing of a spark plug and having a taper-nose portion on one end which is subject to exposure to combustion gas from an internal combustion engine, the taper-nose portion having an outer surface which is partially coated with a coating of a mixture of from 5 to 99 percent by weight of vanadium oxide, calculated as vanadium pentoxide, and from 1 to 95 percent by weight of zirconium oxide, calculated as zirconium dioxide, the coating having an average thickness within a range of from 0.1 to 10 microns.

2. An insulator according to claim 1, wherein said mixture contains at least 50 percent by weight of zirconium oxide, calculated as zirconium dioxide, therein.

3. An insulator according to claim 1, wherein the vanadium oxide comprises at least one member selected from the group consisting of $V_2O_5$ and $V_2O_3$.

4. An insulator according to claim 1, wherein the zirconium oxide comprises at least one member selected from the group consisting of $ZrO_2$ and ZrO.

5. An insulator according to claim 1, wherein said coating is of a porous layer having a plurality of pores therein.

6. An insulator according to claim 5, wherein said porous coating layer is composed of the mixture of vanadium oxide particles and zirconium oxide particles and a plurality of pores among these particles.

7. An insulator according to claim 5, wherein said porous coating layer is a sponge-like porous layer having an irregularly-shaped structure.

8. An insulator according to claim 7, wherein said sponge-like porous coating layer comprises zirconium oxide particles and an irregularly-shaped layer of vanadium oxide interposed therebetween.

9. An insulator according to claim 8, wherein the vanadium oxide in said coating layer closely adheres to the taper-nose portion of the insulator and to the zirconium oxide particles.

10. In a spark plug for an internal-combustion engine and having an insulator for electrically insulating an axially-disposed electrode from a surrounding casing, the improvement wherein the insulator is an insulator according to claim 1.

11. A spark plug according to claim 10, wherein the coating, composed of a mixture of vanadium oxide and zirconium oxide, is fixed to the taper-nose portion and has an average thickness of not more than 10 microns.

12. A spark plug according to claim 10, wherein the mixture is composed of from 5 to 99 percent by weight of vanadium oxide, calculated as vanadium pentoxide, and from 1 to 95 percent by weight of zirconium oxide, calculated as zirconium dioxide.

13. A spark plug according to claim 10, wherein the mixture in said coating contains at least 50 percent by weight of zirconium oxide, calculated as zirconium dioxide, therein.

14. A spark plug according to claim 10, wherein the vanadium oxide comprises at least one member selected from the group consisting of $V_2O_5$ and $V_2O_3$.

15. A spark plug according to claim 10, wherein the zirconium oxide comprises at least one member selected from the group consisting of $ZrO_2$ and ZrO.

16. An insulator suitable for electrically insulating an axially-disposed electrode from a surrounding casing of a spark plug and having a taper-nose portion on one end, the taper-nose portion have an outer surface which is partially coated by an adherent porous coating in which the sole essential components are vanadium oxide and zirconium oxide and in which zirconium oxide particles are adhered together by the vanadium oxide, the zirconium oxide particles having a particle diameter within the range of from 0.1 to 2 microns and comprising at least 50 percent by weight of the coating.

* * * * *

UNITED STATES PATENT AND TRADEMARK OFFICE

CERTIFICATE OF CORRECTION

PATENT NO. : 4,267,483

DATED : May 12, 1981

INVENTOR(S) : Koichi NAKAJIMA, Tomoji ISHIGURO, Takuhiko OKAMOTO, Minoru KONAKA, Minoru NAGAI, Kanji HIGUCHI and Kenji SASAKI It is certified that error appears in the above-identified patent and that said Letters Patent are hereby corrected as shown below:

Title page, [73], Assignees should read --Kabushiki Kaisha Toyota Chuo Kenkyusho and Nippondenso Co., Ltd.--.

Signed and Sealed this

First Day of December 1981

[SEAL]

Attest:

GERALD J. MOSSINGHOFF

Attesting Officer

Commissioner of Patents and Trademarks